US005518059A

United States Patent [19]

Blachowski

[11] Patent Number: 5,518,059

[45] Date of Patent: May 21, 1996

[54] METHOD FOR SETTING A CASTING MOLD FORMED OF A MOLD SAND CONTAINING A BINDER AND A DEVICE FOR CONDUCTING THE METHOD

[76] Inventor: Hermann Blachowski, Adelsberg 30, 79669 Zell im Wiesental, Germany

[21] Appl. No.: 249,971

[22] Filed: May 27, 1994

[30] Foreign Application Priority Data

Jun. 1, 1993 [DE] Germany ..... 43 18 153.8

[51] Int. Cl.[6] ..... B22C 9/00; B22C 15/23

[52] U.S. Cl. ..... 164/16; 164/200

[58] Field of Search ..... 164/12, 16, 19, 164/20, 21, 200, 201, 202

[56] References Cited

U.S. PATENT DOCUMENTS 5,005,630 4/1991 Gahler ..... 164/16

FOREIGN PATENT DOCUMENTS 2437894 6/1980 France ..... 164/16

59-150642 8/1984 Japan ..... 164/16

673238 2/1990 Switzerland ..... 164/16

*Primary Examiner*—Richard K. Seidel

*Assistant Examiner*—I.-H. Lin

*Attorney, Agent, or Firm*—Antonelli, Terry, Stout & Kraus

[57] ABSTRACT

To minimize the amount of setting gas to be gasified and to be introduced into a molding sand containing a gas-settable binder, a metered volume of the setting liquid is injected directly into a gassing plate arranged in front of an opening leading to a cavity containing the molding sand. Heat energy is supplied to the gassing plate to effect gasification of the liquid. A superpure gas then is produced and is directed through the molding sand. Consequently, not only is only a small amount of setting liquid required to set the molding sand but only a small amount of compressed air or other non-reactive gas is required for scrubbing to remove the residual superpure gas from the sand. Therefore, cleaning or removal of the gas from the set molding sand can be performed at a low cost.

10 Claims, 2 Drawing Sheets

METHOD FOR SETTING A CASTING MOLD FORMED OF A MOLD SAND CONTAINING A BINDER AND A DEVICE FOR CONDUCTING THE METHOD

FIELD OF INVENTION

This invention relates to a method for manufacturing a casting mold and, in particular, a casting core, in a molding box from a molding sand containing a gas-settable binder. The sand is loaded from a supply container through a sand feed opening in the molding box into a cavity in the molding box, whereupon a setting liquid, prepared in liquid form, metered, and gasified in a metered amount, penetrates the molding sand to set it, and non-reactive compressed air then flushes the set of casting mold to eliminate the gas obtained from the setting liquid.

BACKGROUND OF THE INVENTION

Several generally known gasification processes use a similar method for setting of casting or molding sand. There includes firstly the $SO_2$ method, in which basically poisonous liquid $SO_2$ is used. In the Betaset method, methyl formate is used as a gas; whereas amine gas is used in the Coldbox method. All of these methods use the same principle described above and utilize costly gases that require disposal after the setting operation.

A method of this kind is described in DE 31 35 510 Al. In this disclosure, the setting liquid measured for a casting mold is first mixed with air. The mixture is completely gasified with the addition of energy and then supplied to a gassing plate of the molding box, from which a quantity of setting gas penetrates the molding sand to be set. Although this method has the advantage that only the amount of liquid intended for a casting mold is gasified, the amount added must be made quite generous for safety reasons, so that the molding sand sets completely. It is also necessary to be sure that a portion of the gas can escape through pipe seals on the transport path from the metering and gassing device to the molding box, but there is the particular danger that a portion of the gas will condense again along this path and hence be lost to the molding sand loaded into the box for setting it. To prevent this condensate from forming, it is conventional to heat the pipes leading to the casting mold, but this is very difficult as well as expensive.

SUMMARY OF THE INVENTION

An object of this invention is to develop a method and a device that allow the setting liquid to be saved. The purpose of the method according to the invention is to prevent a quantity of gas from either being lost or condensing on the way to the molding box. It is also important, however, to avoid using a carrier gas such as air. However, this has the disadvantage that an unnecessarily large quantity of liquid must be supplied to the molding sand and this large quantity of gas must then be disposed of in an expensive fashion following the setting process in the molding sand.

According to the invention, it is proposed to achieve the stated goal by virtue of the fact that the volume of setting liquid prepared for a specific casting mold is supplied to the molding box or to the components belonging thereto in liquid form and is not gasified until the liquid enters the molding box or the components belonging thereto, and the resultant gas then immediately penetrates the molding sand to be set in the molding box.

In this fashion, pipes that might possibly develop leaks are avoided for use with the gas, and undesirable condensation of the gas is also impossible; only a minimum amount of liquid is dispensed and used directly for injection into the molding box for gasification. This liquid, decentrally gasified in this manner and then immediately flowing through the sand as a gas, can be measured more exactly and hence used in smaller quantities. Gas leaks during transit are impossible and a carrier gas is also not required. It is a simple matter to gasify the liquid injected into the gassing plate reliably by adding energy, so that only the gas obtained from the liquid passes through the molding sand, and only this small volume needs to be disposed of after the sand has set. In this manner, up to 90% of the volume of liquid which was formerly conventional can be saved.

A device for working this method comprises a metering device being associated directly with the gassing plate, with the gassing plate having a passage or pipe for liquid metering.

Advantageous further details of the device will be evident from the accompanying drawing, and the detailed description in the specification. In particular, the gassing plate should have a device for adding energy, such as an electrical heating means, for example. For reliable gasification of the injected liquid, it is advantageous to make the evaporating surface in the gas supply channel from the junction of the gassing plate to the filling opening of the molding sand in the molding box as large as possible, possibly zigzag-shaped with evaporating ribs or the like.

BRIEF DESCRIPTION OF THE DRAWINGS

The drawings show an embodiment of the device in schematic views, wherein.

DETAILED DESCRIPTION OF THE INVENTION

Figure 1:
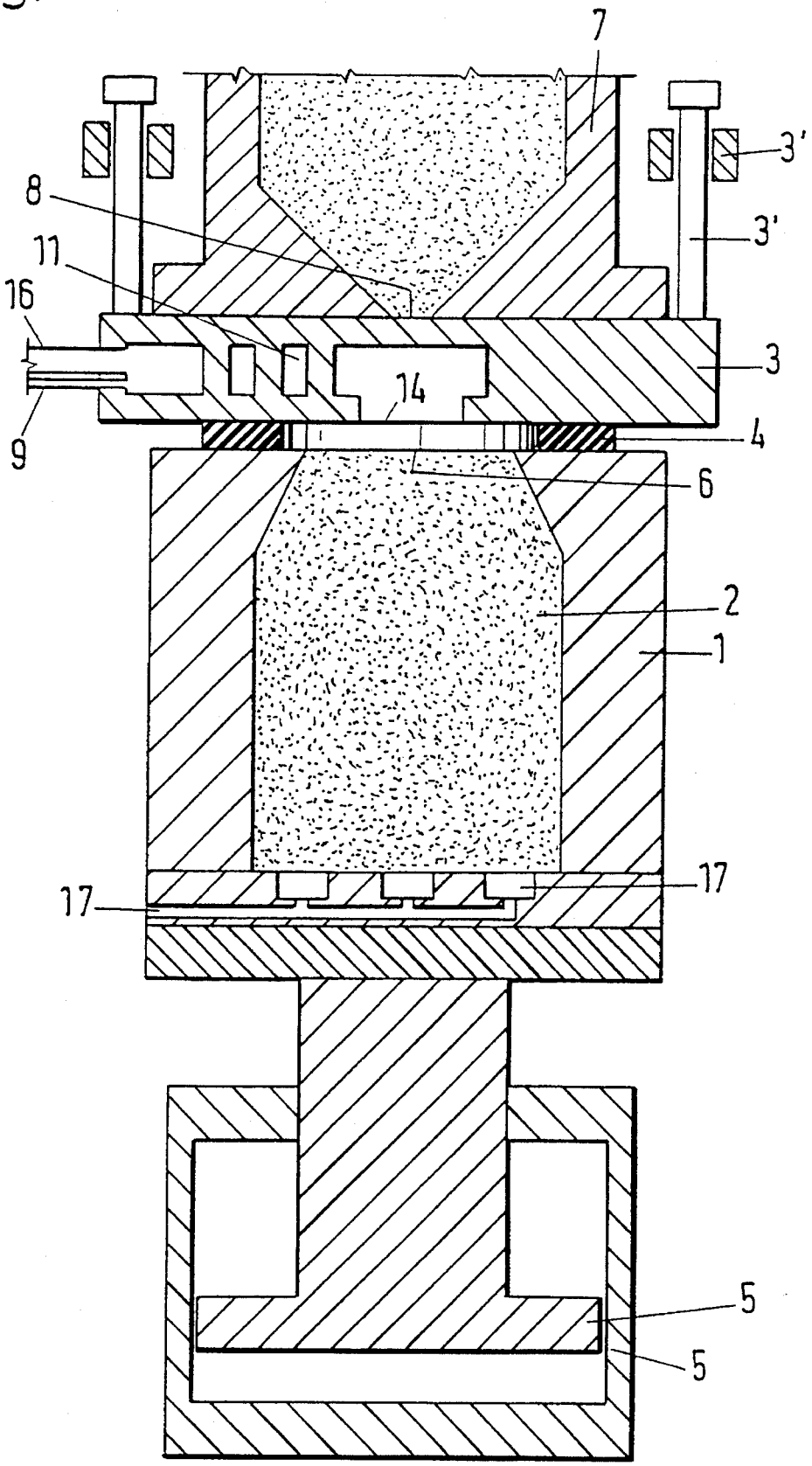
FIG. 1 is a vertical section through the middle of a so-called core shooter.

A core shooter consists of several parts, shown only partially in the drawings, for the sake of clarity. The tool itself, including molding box 1, is important in conjunction with the invention. The chamber surrounded by molding box 1 serves to make the casting mold, for example a casting core 2. It is made of molding sand represented by coarse grains. The sand is mixed with a binder, e.g. furan resin, phenol-resol resin, benzyl ether, and polyisocyanate that can be set by a gas, e.g. $SO_2$, methyl formate and amine.

Above molding box 1, a gassing plate 3 is sealed off by a gasket 4 by means of the upwardly acting pressure cylinder 5 located below the bottom of molding box 1. Gasket 4 mounted, for example, on an intermediate plate, is adapted to the size of the molding sand filling opening 6 of molding box 1. If the filling opening 6 is smaller in diameter, gassing plate 3 is also sealed in the vicinity of the smaller opening 6 by another gasket 4 at the intermediate plate.

Above gassing plate 3 is a shooting or injecting head 7, whose sand outlet opening 8 is centered on molding sand filling opening 6 of molding box 1. When the sand is loaded into the molding box 1, gassing plate 3 supported by parts 3', is swiveled or slid outward. Pressure cylinder 5 is moved upwardly to insure complete sealing during the sand filling process. The molding sand is forced into the molding box under high pressure, with the mechanisms for applying this force not being shown.

Figure 2:
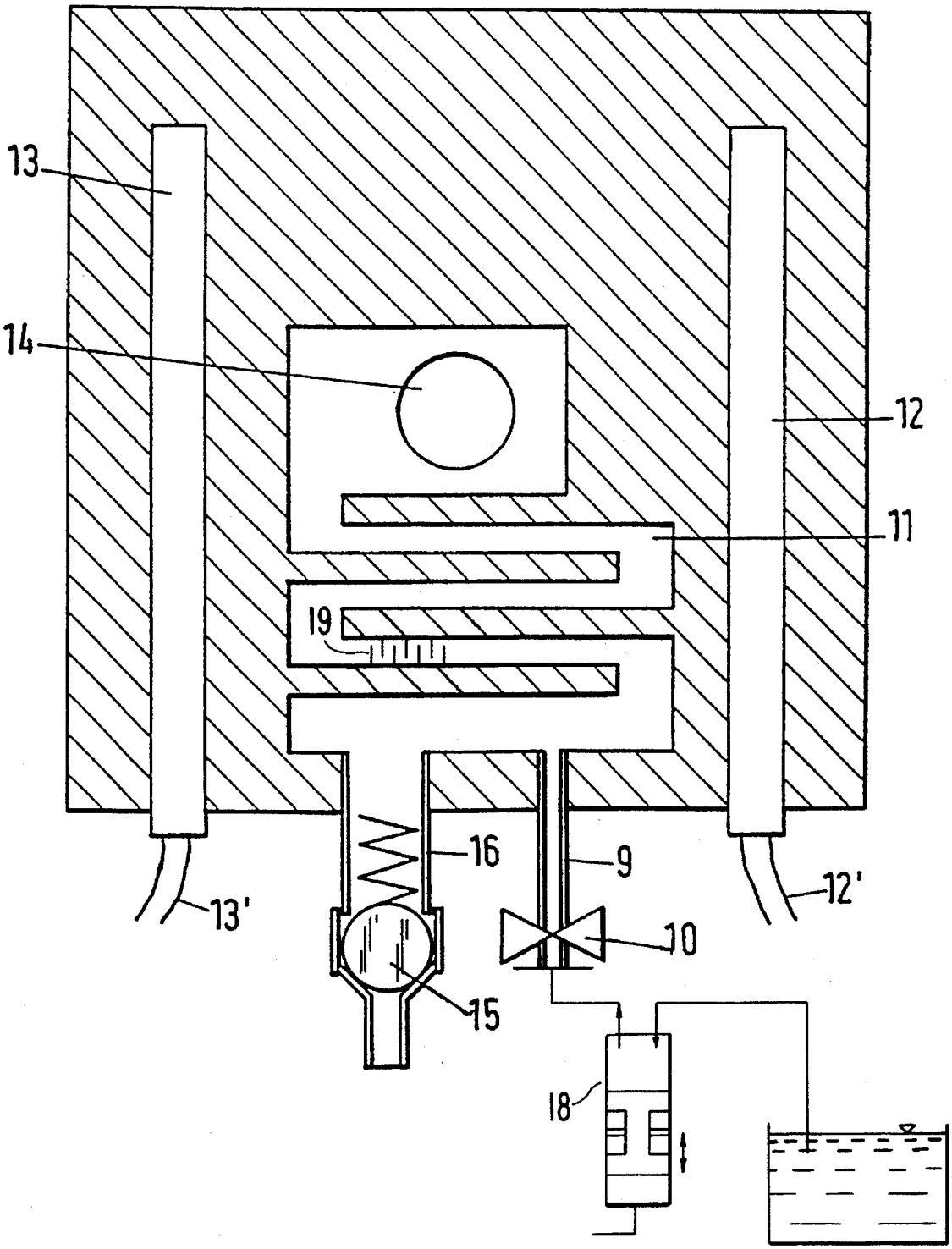
FIG. 2 is a horizontal section through a gassing plate shown in FIG. 1, supported on a molding box.

The gassing plate 3 is shown in cross section in FIG. 2. This plate consists of an arrangement to which liquid is supplied and in which the liquid is evaporated. For this purpose, gassing plate 3 has a pipe or conduit 9 with a valve 10 on one end, directly ahead of which a valve metering device 18 is located. The liquid injected into gassing plate 3 passes through a channel 11 with a large evaporating surface, with only a zigzag channel 11 being shown schematically in FIG. 2. It is important in this connection for a large quantity of heating energy to reach the liquid quickly in order to evaporate it completely. The heat energy is supplied by heating rods 12, 13 with electrical connections 12', 13' to channel 11, which can be provided with additional evaporating ribs 19.

The superpure gas produced in channel 11 then passes directly through outlet opening 14 directed vertically downward, because of the vapor pressure prevailing in channel 11, and through the molding sand filling opening 6 centered thereon into the chamber of molding box 1, i.e. into the molding sand forming casting core 2.

After the molding sand has set, nonreactive flushing air passes through the entire system, i.e. channel 11, outlet opening 14, molding sand filling opening 6, and especially core 2, said air entering under pressure through a check valve 15 and through pipe 16 likewise located on the end of gassing plate 3. This flushing air now need only blow the small amount of gas not consumed out of core 2. For this reason, only a small amount of flushing air need be provided. The flushing device is likewise not shown. It is connected to a housing surrounding the parts shown, into which the flushing air penetrates through lines 17 in the bottom of molding box 1, which are open to core 2.

What is claimed is:

1. A method for manufacturing a casting mold in a molding box from a molding sand containing a gas-settable binder, which comprises introducing the molding sand via a sand filling opening in the molding box into a cavity within the molding box, metering a predetermined amount of setting liquid into a gassing means operatively associated with the molding box and arranged closely adjacent to the cavity, gasifying the setting liquid and then discharging the resulting gas from the gassing means so that the resulting gas passes through the molding sand in the molding box to effect setting of the binder.

2. A method according to claim 1, wherein gasification of the metered amount of liquid is effected by adding energy to the liquid within the component adjacent to the cavity.

3. A method according to claim 2, wherein the energy added to the liquid is heat, the heat being supplied to the gassing means adjacent to the cavity via heating means located therein.

4. A method according to claim 1, wherein said gassing means is a gassing plate positioned immediately adjacent to the sand filling opening for effecting gasification of the liquid prior to introduction into the cavity containing the molding sand.

5. A method according to claim 1 or claim 2, wherein gas produced from the setting liquid penetrates the molding sand in the molding box to effect setting of the binder throughout the molding sand and thereby provide said casting mold.

6. A device for setting a casting mold comprised of a molding sand containing a gas-settable binder, said device comprising a molding box in which a hollow cavity is formed, said cavity determining the casting shape of the molding sand introduced into the cavity, a filling opening leading to the cavity, means for sealing off the filling opening from the surrounding atmosphere and a gassing plate arranged adjacent to a filling opening for gasification of a setting liquid introduced into said plate, said plate comprising a metering device for the setting liquid and means for flushing gas from the molding sand within the cavity with a non-reactive gas; said metering device being located immediately adjacent to the gassing plate and the gassing plate including conduit means as well as valve means for introduction of the liquid and for metering a predetermined volume of liquid into a portion of the gassing plate and means for supplying energy to the liquid in the gassing plate, so that the predetermined volume of liquid is gasified.

7. A device according to claim 6, wherein the gassing plate includes an electrically actuated means for heating the gassing plate.

8. A device according to claim 6 or 7, wherein the gassing plate includes a conduit for admitting the non-reactive gas into said gassing plate in addition to the conduit means for introduction of the setting liquid.

9. A device according to claim 6, wherein the gassing plate includes a gassing channel for directing flow of metered liquid towards the filling opening of the molding box, said channels being provided with means for heating the flowing liquid so that the liquid is gasified prior to entering the filling opening.

10. A device according to claim 9, wherein the gassing channel comprises a plurality of zigzag passages provided with evaporating ribs to promote gasification of the liquid.

* * * * *